US005561992A

United States Patent [19]

Carloni

[11] Patent Number: 5,561,992

[45] Date of Patent: Oct. 8, 1996

[54] ELECTRIC DOMESTIC APPLIANCE FOR WASHING AND/OR DRYING USING HOT WATER FROM THE CENTRAL SYSTEM CIRCULATING IN COILS

[76] Inventor: Franco Carloni, Residenza 51, 6528 Camorino, Switzerland

[21] Appl. No.: 495,634

[22] PCT Filed: Dec. 2, 1994

[86] PCT No.: PCT/EP94/04035

§ 371 Date: Aug. 4, 1995

§ 102(e) Date: Aug. 4, 1995

[87] PCT Pub. No.: WO95/16066

PCT Pub. Date: Jun. 15, 1995

[30] Foreign Application Priority Data

Dec. 9, 1993 [CH] Switzerland ..... 3662/93

[51] Int. Cl.[6] ..... D06F 39/04; D06F 39/08; A47L 15/42

[52] U.S. Cl. ..... 68/16; 34/86; 68/20; 68/207; 134/105

[58] Field of Search ..... 68/15, 16, 20, 68/207; 134/105, 107; 34/86, 90, 513

[56] References Cited

U.S. PATENT DOCUMENTS

| | | | |
|---|---|---|---|
| 3,406,413 | 10/1968 | Ridley | 68/15 X |
| 4,376,378 | 3/1983 | Svenningsen | 68/207 X |
| 4,514,914 | 5/1985 | Kitzmiller . | |
| 4,727,733 | 3/1988 | Huber | 68/207 X |

FOREIGN PATENT DOCUMENTS

| | | |
|---|---|---|
| 0355450 | 2/1990 | European Pat. Off. . |
| 1238428 | 4/1967 | Germany . |
| 121316 | 7/1927 | Switzerland . |
| 347812 | 9/1960 | Switzerland . |

*Primary Examiner*—Philip R. Coe
*Attorney, Agent, or Firm*—Young & Thompson

[57] ABSTRACT

An electric domestic appliance (1) with programmer (5) for washing and/or drying dishes or laundry which uses in its cycles hot water from a central heating system introduced into its interior mixed by a mixer (2) with a predetermined quantity of cold water, and which also includes coil pipes (3) disposed in the vicinity of the section where the washing and/or drying takes place. Such pipes can be connected to the mixer (2) by a diverter (4) which, on command from the programmer, can divert the flow of water emerging from the mixer towards them or towards the interior of the appliance (1). The heat of the coil pipes can also be used to achieve drying via electric fans.

2 Claims, 2 Drawing Sheets

ELECTRIC DOMESTIC APPLIANCE FOR WASHING AND/OR DRYING USING HOT WATER FROM THE CENTRAL SYSTEM CIRCULATING IN COILS

FIELD OF THE INVENTION

The invention relates to the field of electric domestic appliances used for washing and/or drying dishes or laundry.

BACKGROUND OF THE INVENTION

With the above-mentioned appliances, various washing and/or drying cycles are carried out which are controlled by a programmer and which must almost always use water or air heated to a predetermined temperature.

Because the thermal energy produced by means of electric resistances has proved substantially more expensive than that produced by means of the burner of a central heating system, there are various appliances in the prior art which, for the washing operation, draw water from the central hot-water system and mix it by means of a mixer with a required quantity of cold water before introducing it into the appliance, generally at the bottom of same, so that the different types of cycle can be carried out. The programmer controls the operation of the mixer so as to arrive at the temperatures indicated for the various cycles.

However nowadays this type of operation has various disadvantages.

The first of these is that the water, once introduced into the electric domestic appliance, gradually cools on contact with the appliance and the articles to be washed or dried, and therefore, in order to be efficient, the cycle must have a duration relative to the average temperature which the water will have during said cycle, for which reason such duration will be appreciably greater than that which would be required for a cycle during which the water maintained a constant temperature.

SUMMARY OF THE INVENTION

The second disadvantage is due to the fact that, in the majority of prewash cycles, for example in washing-machines, where such an operation takes place at a temperature of approx. 40° C., the water, coming into contact with the incrustations of dirt on the fabrics at that temperature, confer to the dirt itself a resistance against removal which is greater than that which this would have if the prewash were carried out at a lower temperature. Therefore an appliance would be beneficial which could start the prewash at a low temperature, and could then increase the temperature of the water gradually as required, for example up to about the 40° C. mentioned above.

In addition, washing-machines known as washer/dryers in particular are not able to dry all the laundry which they can hold for washing. This operation is therefore usually best carried out by means of a further appliance designed exclusively for this purpose which uses the heat produced by resistors incorporated inside elements of suitable design.

The best result would involve a washing-machine which could change the temperature of the water during its various cycles without resorting to expensive electrical energy and which could also proceed to dry all the washed laundry without this having to be removed either in total or in part from the appliance, or a dryer which could dry the laundry without resorting to heat produced electrically. In the case of dish-washers, the problems are similar and it would be convenient not to have to resort to the use of electrical energy either for heating the water or for drying the dishes.

One solution of these problems has been proposed by the inventor by means of the object of this application, namely an electric domestic appliance corresponding to the state of the art described in the preamble of the attached claim 1, but characterized in accordance with the characterizing section of said claim 1.

BRIEF DESCRIPTION OF THE DRAWINGS

A preferred embodiment according to the invention is now described in more detail, reference also being made to the attached drawings in which.

DETAILED DESCRIPTION OF THE DEVICE

Figure 1:
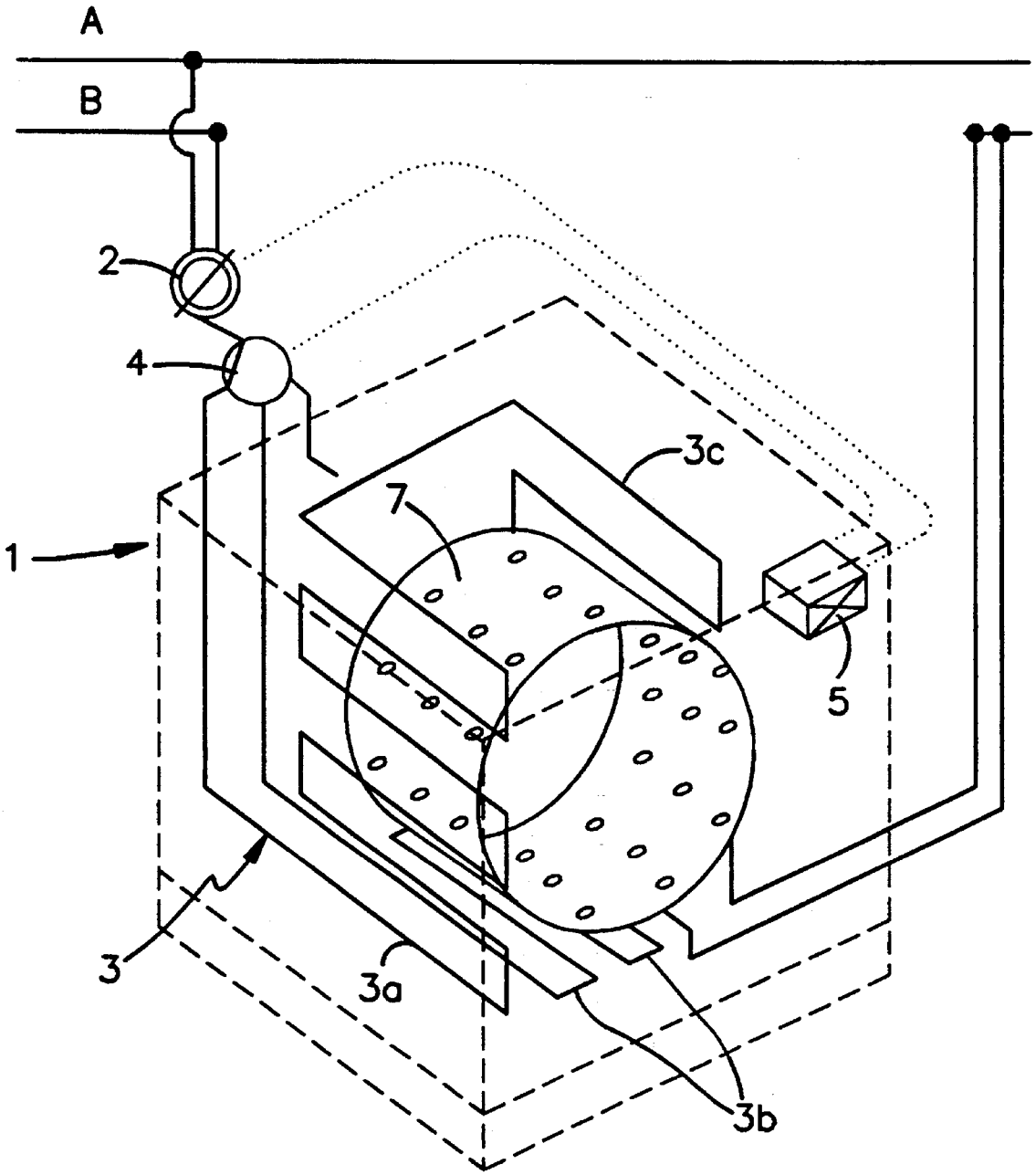
FIG. 1 shows a perspective schematic view, seeing through a washing-machine according to the invention.

With reference to FIG. 1, in an electric domestic appliance according to the invention (a washing-machine in the illustrated example), the washing section, essentially delimited by the rotating drum 7, is surrounded by a coil pipe 3 comprising, in the example in question, three coil sections 3*a*, 3*c* and 3*b* respectively disposed vertically along the two opposite sides of the drum 7 and horizontally on the bottom of the appliance, i.e. where the water stands.

The water coming from the pipes A and B, respectively supplying cold water and hot water, is introduced into the appliance at a predetermined temperature by operating the mixer 2 by means of a programmer 5 which is known per se.

This programmer, once "loading" of the appliance is complete, can divert the flow of water, at the same temperature as that introduced until now or at a different temperature by continuing to duly operate the mixer 2 and the diverter 4, which directs it for example towards the single coil 3*b* on the bottom. The water, which can also come exclusively from the pipe B of the central system which provides hot water for the house in which the appliance 1 is installed, passes through said coil 3*b* and imparts some of its heat to the water standing on the bottom of the appliance 1 before again entering the pipe for recirculation in the central system.

By influencing as appropriate both the temperature of the water introduced into the appliance and the temperature of the water circulating in the coils (both coming from said mixer 2), it is possible to regulate as required the resultant temperature of the water which carries out the various stages of washing, subsequently keeping it virtually constant for the entire duration of the individual cycles, producing greater washing efficiency with a cycle of predetermined duration, or else reducing its duration whilst achieving the same efficiency.

And all this without having to resort to the use of electrical energy.

Finally, in the subsequent drying stage, the programmer again acts both on the diverter 4 and on the mixer 2, so that only hot water (namely at the maximum temperature supplied by the central system), is supplied to the coils 3*a*, 3*c* which are disposed vertically on opposite sides of the washing section, i.e. the drum 7 in the case of a washing-machine, or the washing compartment in the case of a dish-washer.

Figure 2:
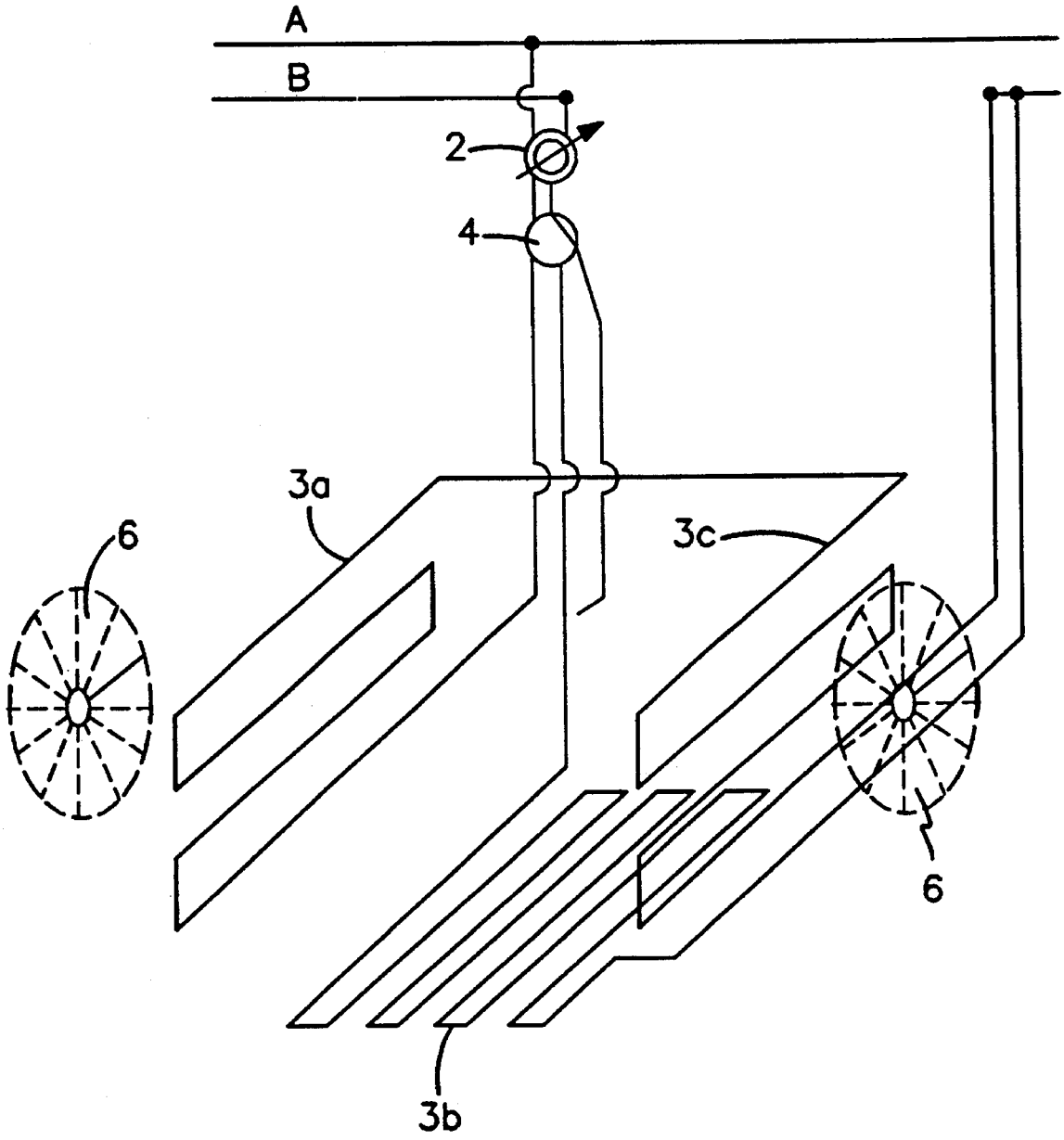
FIG. 2 shows a diagram of a possible arrangement of the coils which is effective both for washing-machines and for dish-washers and dryers.

The circuit of the coil pipes is completely identical in both cases, and is illustrated in FIG. 2.

Drying is carried out by means of a plurality of electric fans 6, suitably disposed so as to convey air over the coils 3*a*, 3*b* and 3*c* and therefore over the laundry or over the dishes to be dried. Of course it is convenient to arrange cooling fins (not illustrated) on the coils 3*a*, 3*c*.

The same criterion can be applied in the case of an appliance designed only for drying laundry, in which appliance the diverter 2 may also not be used, the hot water coming from the system arriving, preferably at its maximum temperature, in the above-mentioned coils 3*a*, 3*b*, 3*c*, disposed in the most suitable way to obtain the best thermal exchange.

Therefore it is possible to carry out the above-mentioned drying, once again without having to use electrical energy to produce heat, thus achieving a considerable economic saving and moreover carrying out the various cycles so that they are shorter in duration and take place at almost constant temperatures.

It will be clear that, with a washing-machine according to the invention, the problem no longer existing of expenditure of energy co-related to the use of electric coils, hot-water rinses can also be carried out with a much improved washing efficiency. The total time taken to complete a washing cycle is also substantially reduced: by using water already heated by the central system, the long pauses necessary to allow the electric coils to heat the water are no longer to be expected.

The objectives put forward by the inventor are therefore achieved.

As regards the saving in energy achieved, it is sufficient to consider that in order to produce the same quantity of heat electrically or with the burner of the central heating system, the respective costs are in a ratio of approx. 3.7 to 1. The theoretical saving which can be achieved is therefore equal to 73%.

There are numerous modifications open to an expert in the field which may relate to the configuration, arrangement and number of coil pipes, the type of components selected for the mixing and diversion of the water flows, etc.

Embodiments thus achieved, which however can be attributed to the disclosures in the attached claims, are always included in the scope of protection conferred by this patent application, even if only a preferred embodiment has been represented in this, since this is not to be considered unalterable or limitative with respect to said possible variations.

I claim:

1. In an electric domestic appliance for washing and/or drying articles in a compartment, said appliance including a programmer, and being operatively associated with a central heating system having means for supplying hot water to the interior of said appliance, and mixing means for mixing the hot water with a predetermined quantity of cold water, the improvement wherein said appliance further comprises coil pipe means disposed in the vicinity of the area where the washing and/or drying takes place, said coil pipe means being fluidly connected to said mixing means via a diverter positioned downstream of said mixing means, and said diverter including means responsive to commands from said programmer for diverting flow of water towards at least one of said coil pipe means and the interior of said appliance.

2. Appliance according to claim 1, wherein said coil pipe means comprise at least three coil pipes, a first of said coil pipes being disposed in a bottom area of the compartment, and the other two coil pipes being disposed vertically on two opposite sides of said compartment, said appliance further comprising a plurality of electric fans arranged to orient their air flows so as to reach the washing and/or drying area after having passed over at least the two vertically disposed coil pipes.

* * * * *